US006048256A

United States Patent [19]

Obeng et al.

[11] Patent Number: 6,048,256

[45] Date of Patent: Apr. 11, 2000

[54] APPARATUS AND METHOD FOR CONTINUOUS DELIVERY AND CONDITIONING OF A POLISHING SLURRY

[75] Inventors: Yaw S. Obeng, Orlando; Laurence D. Schultz, Kissimmee, both of Fla.

[73] Assignee: Lucent Technologies Inc., Murray Hill, N.J.

[21] Appl. No.: 09/286,869

[22] Filed: Apr. 6, 1999

[51] Int. Cl.[7] ..... B24B 7/19; B24B 7/30

[52] U.S. Cl. ..... 451/60; 451/87; 451/5

[58] Field of Search ..... 451/5, 6, 28, 36, 451/60, 91, 99, 100, 446, 87, 88; 222/145.1, 145.6, 129; 156/345 LP; 438/692, 693, 8; 216/38, 84, 86, 88, 89

[56] References Cited

U.S. PATENT DOCUMENTS

| | | | |
|---|---|---|---|
| 5,478,435 | 12/1995 | Murphy et al. | 156/345 LP |
| 5,522,660 | 6/1996 | O'Dougherty et al. | 366/136 |
| 5,637,185 | 6/1997 | Murarka et al. | 156/345 LP |
| 5,668,063 | 9/1997 | Fry et al. | 438/693 |
| 5,700,180 | 12/1997 | Sandhu et al. | 451/5 |
| 5,750,440 | 5/1998 | Vanell et al. | 438/692 |
| 5,851,846 | 12/1998 | Matsui et al. | 438/692 |
| 5,857,893 | 1/1999 | Olsen et al. | 451/5 |
| 5,863,838 | 1/1999 | Farkas et al. | 438/693 |
| 5,876,508 | 3/1999 | Wu et al. | 438/692 |

*Primary Examiner*—Derris Holt Banks

[57] ABSTRACT

The present invention provides a continuous slurry delivery system for use with a polishing apparatus employing a slurry. The continuous slurry delivery system comprises a mixing chamber, slurry component tanks, a chemical parameter sensor system, and a control system. Each of the slurry component tanks contains a different slurry component and is in fluid connection with the mixing chamber to deliver a required rate of the different slurry component to the mixing chamber. The chemical parameter sensor system is coupled to the mixing chamber and configured to sense a chemical property of the slurry. The control system is coupled to the chemical parameter sensor system and is configured to introduce at least one of the slurry components at a given rate to the mixing chamber.

23 Claims, 3 Drawing Sheets

APPARATUS AND METHOD FOR CONTINUOUS DELIVERY AND CONDITIONING OF A POLISHING SLURRY

TECHNICAL FIELD OF THE INVENTION

The present invention is directed, in general, to a polishing apparatus and method of use of that apparatus and, more specifically, to an apparatus and method for preparing, conditioning, and delivering of a polishing slurry used in the chemical mechanical planarization of semiconductor wafers during the polishing process.

BACKGROUND OF THE INVENTION

In the fabrication of semiconductor components, the various devices are formed in layers upon an underlying substrate that is typically composed of silicon, germanium, or gallium arsenide. The discrete devices are interconnected by metal conductor lines to form the desired integrated circuits. The metal conductor lines are further insulated from the next interconnection level by thin films of insulating material deposited by, for example, CVD (Chemical Vapor Deposition) of oxide or application of SOG (Spin On Glass) layers followed by fellow processes. In such microcircuit wiring processes, it is essential that both the insulating and metal layers have smooth topographies, since it is difficult to lithographically image and pattern layers applied to rough surfaces.

Chemical/mechanical polishing (CMP) has been developed for providing a smooth semiconductor topography. CMP can be used for planarizing: (a) the substrate; (b) insulator surfaces, such as silicon oxide or silicon nitride, deposited by chemical vapor deposition; (c) insulating layers, such as glasses deposited by spin-on and reflow deposition means, over semiconductor devices; or (d) metallic conductor interconnection wiring layers.

Briefly, CMP involves holding and rotating a thin, reasonably flat, semiconductor wafer against a rotating polishing surface. The polishing surface is wetted by a chemical slurry, under controlled chemical, pressure, and temperature conditions. The chemical slurry contains a polishing agent, which is an abrasive material, and chemicals chosen to selectively etch or oxidize particular surfaces of the wafer during CMP. It may be desirable to perform the chemical etching and mechanical abrasion steps simultaneously or sequentially. The combination of chemical etching and mechanical removal of material during polishing results in superior planarization of the polished surface.

One problem area associated with chemical/mechanical polishing is in the area of slurry preparation and storage. As the polishing slurry is a suspension of a mechanical abrasive in a liquid chemical agent, the suspension is normally premixed as a batch and stored in a batch tank of about 350 gallon capacity. The premix tank is connected to another tank, commonly called a "day tank," of about 50 gallon capacity by an extensive plumbing system. The plumbing system allows the slurry to be continuously re-circulated between the day tank and the premix tank. This approach hopes to minimize settling and agglomeration of the particulates in suspension and maintain a reasonably uniform mixture. In total, a single batch of slurry may have a volume of about 350 gallons. Once mixed, the slurry "brew" needs from about one-half hour to 12 hours of vigorous agitation/recirculation before the slurry is useable in order to insure reasonable uniformity.

The effectiveness of the CMP process depends significantly upon the physical parameters, for example: chemical concentration, temperature, pH, specific gravity, etc., of the slurry. Because of the large slurry volume, i.e., 350 gallons, it is extremely difficult to make small adjustments to the mixture in a timely manner. Additionally, the large volume of slurry commits the CMP equipment to a particular process, e.g., planarization of a metal layer, because of the incompatibility of the chemicals in a particular slurry mix to the planarization of a different material, e.g., a dielectric. Modification of the chemical properties of the total slurry mix is very difficult. Therefore, a large quantity of highly refined and expensive chemicals must be ultimately used, stored or disposed. Environmentally, this presents a significant challenge as the CMP apparatus is changed from material process to material process, e.g., polishing substrate, to polishing metal, to polishing dielectric, etc. Of course, the changeover process is time consuming and ultimately very expensive when the high cost of the potentially wasted slurry and lost processing time is considered.

Accordingly, what is needed in the art is a slurry preparation apparatus that: provides a continuous slurry delivery system, constantly monitors the slurry parameters, and continually adjusts the slurry components to correct the slurry parameters to nominal values.

SUMMARY OF THE INVENTION

To address the above-discussed deficiencies of the prior art, the present invention provides a continuous slurry delivery system for use with a polishing apparatus employing a slurry. In one embodiment, the continuous slurry delivery system comprises a mixing chamber, slurry component tanks, a chemical parameter sensor system, and a control system. Each of the slurry component tanks contains a different slurry component and is in fluid connection with the mixing chamber to deliver a required rate of the different slurry component to the mixing chamber. The chemical parameter sensor system is coupled to the mixing chamber and configured to sense a chemical property of the slurry. The control system is coupled to the mixing chamber and the chemical parameter sensor system. The control system is configured to control the introduction of at least one of the slurry components at a given rate to the mixing chamber.

Thus, in a broad scope, the present invention provides a slurry dispensing system that allows the slurry composition to be easily changed or adjusted as processes parameters require. This system, therefore, allows for a more continuous polishing and fabrication process, which also reduces fabrication costs and increases overall production efficiency.

In one embodiment, the chemical property sensed may be an ion concentration or conductivity. For example, the ion sensed may be: hydronium ion ($H_3O^{30}$), hydroxyl ion ($OH^{31}$), metal ion, or non-metal ion concentration. In an alternative embodiment, the different slurry components may he: an oxidant, a surfactant, an abrasive, a buffer, a corrosion inhibitor, an acid, a base, or water, which are typically used during the polishing of a semiconductor wafer. In yet another embodiment, the mixing chamber may comprise a pre-mixing chamber and the continuous slurry delivery system further comprises a pre-dispensing chamber in fluid connection with the pre-mixing chamber. The chemical parameter sensor system may be coupled to the ore-mixing chamber or the pre-dispensing chamber.

The continuous slurry delivery system may further comprise a physical parameter sensor system that is coupled to the mixing chamber and that is configured to sense a physical property of the slurry. Exemplary physical properties that may be sensed are: pressure, temperature, humidity, density, viscosity, zeta potential and light transmittance for turbidity.

In an alternative embodiment, the mixing chamber may further comprise an agitator for mixing the slurry. The slurry component tanks may, in another embodiment, further comprise a meter device configured to meter a measured rate of the different slurry component into the mixing chamber.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction With the accompanying drawings, in which.

DETAILED DESCRIPTION

Figure 1:
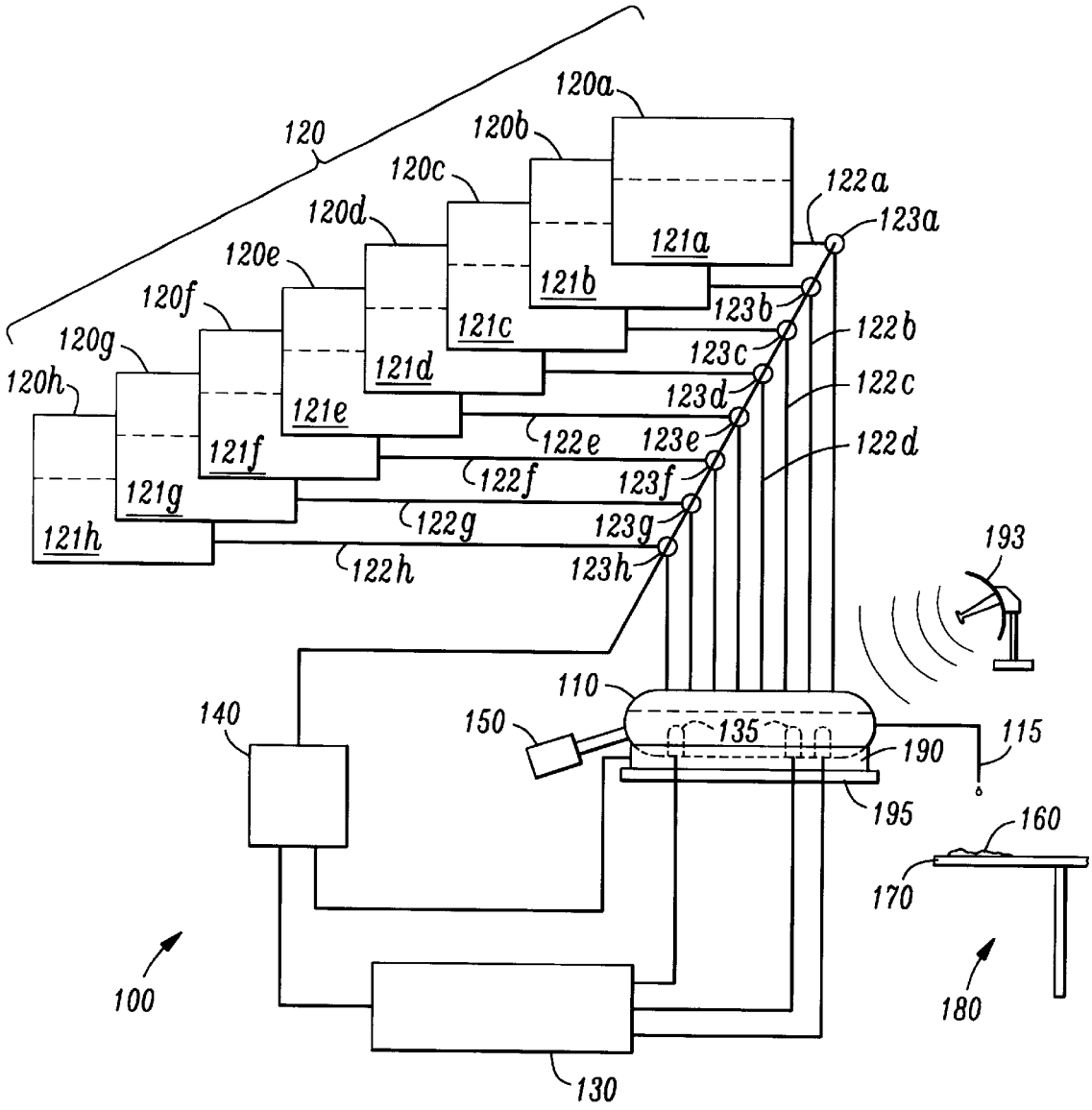
FIG. 1 illustrates one embodiment of a continuous slurry delivery system constructed according to the principles of the present invention.

Referring initially to FIG. 1, illustrated is one embodiment of a continuous slurry delivery system constructed according to the principles of the present invention. A continuous slurry delivery system 100 comprises a mixing chamber 110, a slurry dispenser 115, slurry component tanks collectively designated 120 and individually designated 120*a*–120*h*, a chemical parameter sensor system 130, and a control system 140. In one preferred embodiment, the mixing chamber 110 has a volume that is relatively small when compared to the total volume of the delivery system. For example, in one embodiment, the mixing chamber 110 may have a volume of about 0.5 gallons where the total system volume may be as much as 350 gallons. However, it should be understood that larger volumes for the mixing chamber 110 are also within the scope of the present invention.

Each of the slurry component tanks 120*a*–120*h* contains a different slurry component essential to the overall polishing and conditioning processes; for example, an oxidant 121*a*, a surfactant 121*b*, an abrasive 121*c*, a buffer 121*d*, a corrosion inhibitor 121*e*, an acid 121*f*, a base 121*g*, or water 121*h*. Of course, one who is skilled in the art will recognize that other different types of slurry components may also be used. As shown, the slurry component tanks 120*a*–120*a* are individually in fluid communication with the mixing chamber 110. For the purposes of this discussion, fluid communication means having a conduit 122*a*–122*h* between the individual component tanks 120*a*–120*h* and the mixing chamber 110 that is suitable for conducting the component from each component tank 120*a*–120*h* to the mixing chamber 110. For example, fluids, such as water 121*h*, may have a tube 122*h* directly connecting to the mixing chamber 110. One who is skilled in the art is familiar with the problems and conventional solutions of dispensing liquid and powdered components through a conduit or other type of delivery system. Each slurry tank 120*a*–120*h*is equipped with a metering device 123*a*–123*h* that is configured to meter a measured rate of the respective component 121*a*–121*h* into the mixing chamber 110.

The mixing chamber 110 further comprises an agitator 150 that concusses the contents of the chamber 110 so as to produce a substantially uniform slurry 160 that is delivered to a polishing platen/pad 170 of a polishing apparatus 180. The slurry 150 is a chemical suspension of some of the individual components 121*a*–121*h* described above. One who is skilled in the art is aware that the exact composition of the slurry 160 will vary depending upon what material is to be planarized.

The chemical parameter sensor system 130 is coupled to the mixing chamber 110 and, through sensors 135, configured to sense a chemical property, for example, an ion concentration or conductivity of the slurry 160. More specifically, the chemical property sensed may be a hydronium ($H_3O^+$), hydroxyl ion ($OH^{31}$ )metal, or non-metal ion concentration; or oxidant concentration. This ion concentration, or another chemical or physical property, is analyzed by the control system 140, which determines what chemical components 121*a*–121*h* are deficient or excessive in the slurry 160, and sends a command to one or more of the metering devices 123*a*–123*h* to introduce the appropriate chemical components 121*a*–121*h* into the mixing chamber 110 at an appropriate rate to adjust the slurry 160 composition.

For example, the chemical parameter sensor system 130 may, during polishing of a metal, determine that the initial pH of the slurry 160 is 4.7. The desired pH for the process may be 4.5. The control system 140 would compare the actual pH of 4.7 to the desired 4.5 and command the metering device 123*f* to introduce a calculated rate of acid 121*f* from acid component tank 120*f* into the mixing chamber 110. One who is skilled in the art will immediately recognize that by continuous monitoring of multiple chemical parameters, the slurry 160 composition will vary only slightly from the desired parameters. Thus, the close controlling of the slurry 160 composition speeds the CMP process and improves semiconductor wafer throughout. Also, by having water 121*h* or other solvents/detergents (not shown) in separate component tanks 120, the mixing chamber 110 and slurry dispenser 115 can quickly he flushed and prepared to change over to a different process, e.g., from metal polishing to dielectric polishing. The large batch size of the prior art is therefore avoided; and the disposal of excess slurry mixture is avoided while slurry components are kept isolated from one another. Thus, environmentally, the chemicals 121*a*–121*h* are retained in the individual component tanks 120*a*–120*h* until they are needed in relatively small quantities, thereby avoiding the waste of potentially hazardous chemicals that, once mixed, cannot be economically separated.

The continuous slurry delivery system 100 may further comprise a physical parameter sensor system 190 coupled to the mixing chamber 110 and the control system 140. The physical parameter sensor system 190 may collect current data on, for example, the temperature, pressure, humidity, turbidity, density, viscosity, zeta potential, light transmittance etc., of the slurry mixing chamber 110. The control system 140 processes this information and makes needed adjustments to the environment. For example, the actual environmental temperature may be 50° C., when the desired temperature is 55° C. The control system 140, sensing the difference, then commands a heater 193 to increase the environmental temperature until 55° C. is reached. If the slurry temperature is the controlling factor, then it may also be sensed as just described, and adjusted by, for example, a cold or hot water bath 195 around the mixing chamber 110. One who is skilled in the art is familiar with the methods of controlling physical parameters of suspensions.

The continuous slurry delivery system 100 may further comprise a pressurizing system (not shown) and directable pressure nozzle for delivery of a selected one or more of the components to the polishing platen/pad 170, such as water or other cleaning fluid. In such embodiments, the pressurized system can be used to clean and condition the polishing pad between various polishing operations. One who is skilled in the art is familiar with pressurized fluid delivery systems that could be used in this aspect of the present invention.

Figure 2:
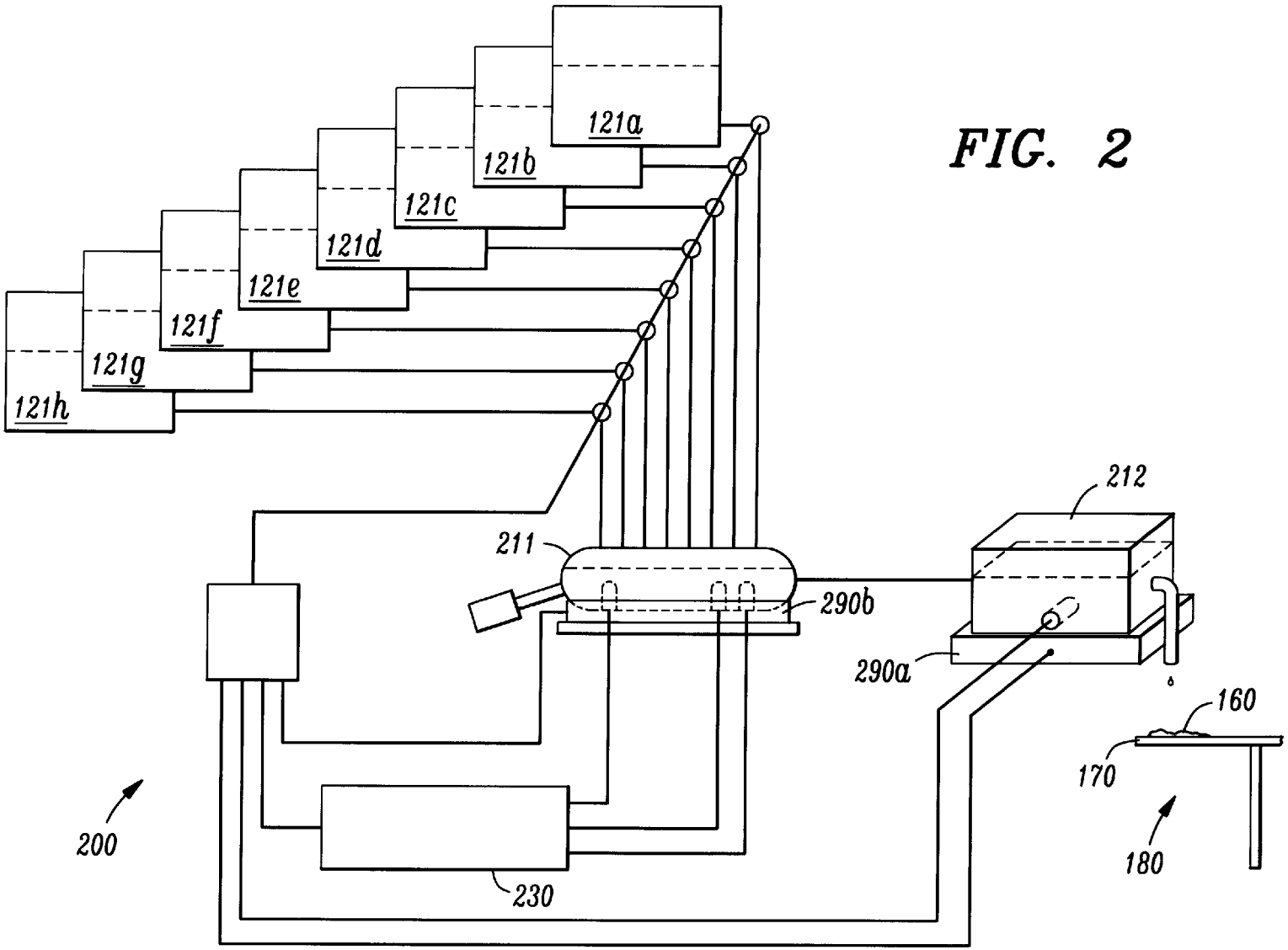
FIG. 2 illustrates an alternative embodiment of the continuous slurry delivery system of FIG. 1.

Referring now to FIG. 2, illustrated is an alternative embodiment of the continuous slurry delivery system of FIG. 1. In this embodiment, the continuous slurry delivery system 200 may comprise a pre-mixing chamber 211 and a pre-dispensing chamber 212. Slurry mixing from the individual components 121*a*–121*h* occurs in the pre-mixing chamber 211. The slurry 160 is then delivered to the pre-dispensing chamber 212, whence the slurry 160 is dispensed onto the polishing platen/pad 170. In this embodiment, a chemical parameter sensor system 230 and a physical parameter sensing system 290*a*, 290*b* may be coupled to both the pre-mixing chamber 211, as in 290*b*, and the pre-dispensing chamber 212, as in 290*a*. Of course, portions of the sensing systems 230, 290*a*, 290*b* may be distributed as desired for optimum performance. The advantages of locating particular sensors on either the pre-mixing chamber 211 or the pre-dispensing chanter 212 is readily understood by one who is skilled in the art and does not effect the scope of the present invention.

Figure 3:
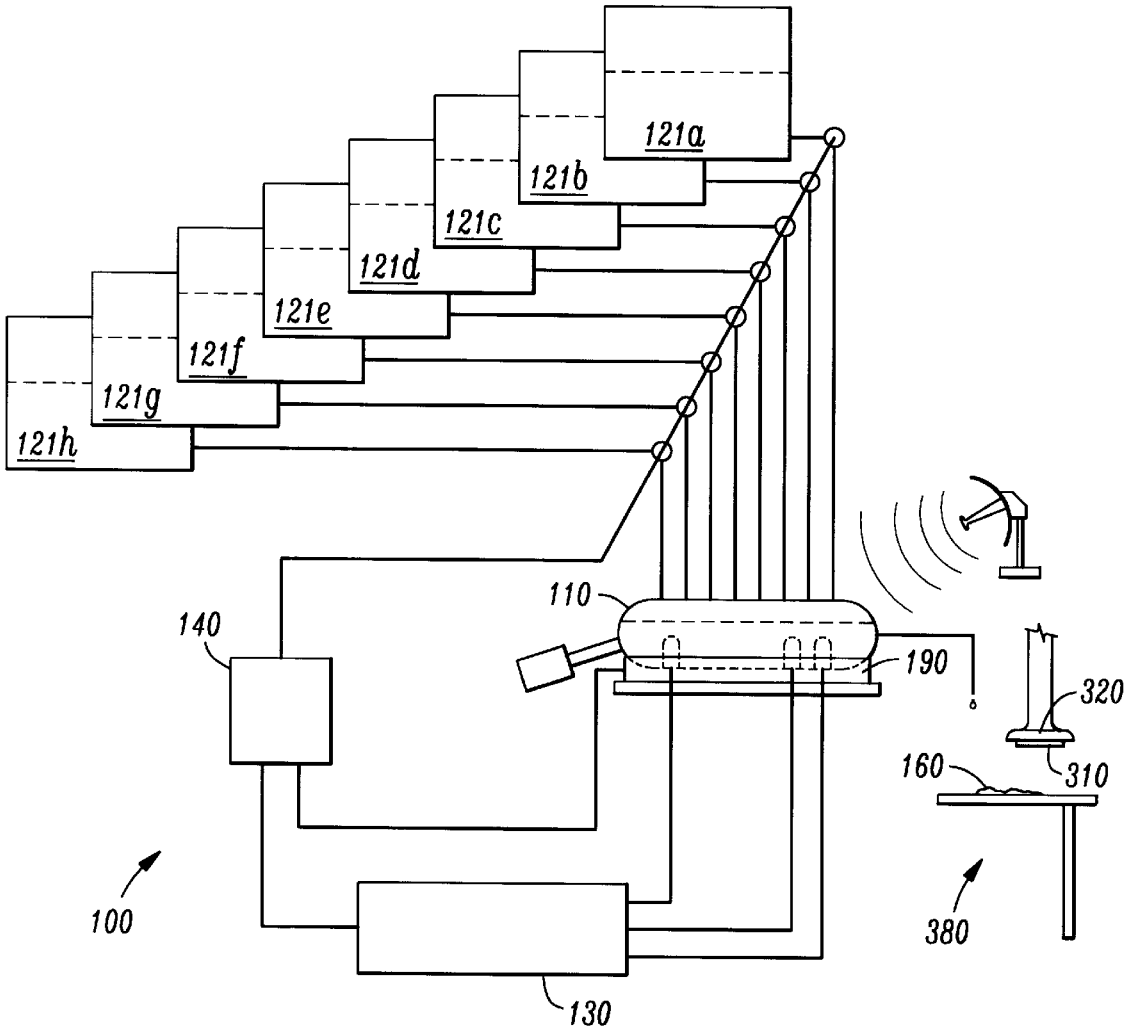
FIG. 3 illustrates an elevational view of the continuous slurry delivery system of FIG. 1 in use with a semiconductor polishing apparatus.

Referring now to FIG. 3, illustrated is an elevational view of the continuous slurry delivery system of FIG. 1 in use with a semiconductor polishing apparatus. A semiconductor wafer 310 has been installed in a polishing head 320 of a polishing apparatus 380. The semiconductor wafer 310 may be at any stage of manufacture requiring planarization, e.g., substrate, metal layer, microcircuit formed, dielectric layer, etc. The chemical parameter sensing system 130 continually monitors chemical parameters prescribed, and necessary adjustments to the rate of dispensing of slurry components 121*a*–121*h* are made by the control system 140 to maintain the actual chemical parameters within very close tolerance of the desired parameters. Likewise, the physical parameter sensor system 190 senses the actual value of prescribed physical parameters and adjustments are made by the control system 140 as described above. The semiconductor wafer 310 is polished in a conventional manner well known to one who is skilled in the art. Significantly, only minimal quantities of the slurry 160, on the order of 2 liters, are ever mixed at any one time. Thus, mixing slurry 160 far in excess of the current need is avoided, as well as waste and potential pollution. Disposal of unneeded slurry 160 is minimized and costs are significantly reduced. Changing from substrate, to metal, to dielectric planarization processes is accomplished rapidly and at minimal cost.

Although the present invention has been described in detail, those skilled in the art should understand that they can make various changes, substitutions and alterations herein without departing from the spirit and scope of the invention in its broadest form.

What is claimed is:

1. For use with a polishing apparatus employing a slurry, a continuous slurry delivery system, comprising:

a mixing chamber;

slurry component tanks, each of said slurry component tanks containing a different slurry component and in fluid connection with said mixing chamber to deliver a required rate of said different slurry component to said mixing chamber;

a chemical parameter sensor system coupled to said mixing chamber and configured to sense a chemical property of said slurry;

a control system coupled to said chemical parameter sensor system and said mixing chamber, said control system configured to introduce at least one of said slurry components at a given rate; and a pre-dispensing chamber in fluid connection with said mixing chamber, said mixing chamber having a volume substantially less than a total volume of said slurry delivery system.

2. The continuous slurry delivery system as recited in claim 1 wherein said chemical property is an ion concentration or conductivity.

3. The continuous slurry delivery system as recited in claim 2 wherein said ion concentration is selected from the group consisting of:

hydronium ion concentration, hydroxyl ion concentration, metal ion concentration, and non-metal ion concentration.

4. The continuous slurry delivery system as recited in claim 1 wherein said different slurry components are selected from the group consisting of:

an oxidant, a surfactant, an abrasive, a buffer, a corrosion inhibitor, an acid, a base, and water.

5. The continuous slurry delivery system as recited in claim 1 wherein said chemical parameter sensor system is coupled to said pre-mixing chamber or said pre-dispensing chamber.

6. The continuous slurry delivery system as recited in claim 1 further comprising a physical parameter sensor system coupled to said control system and said mixing chamber, said physical parameter sensor system configured to sense a physical property of said slurry, and said control system is configured to adjust a physical parameter of said slurry.

7. The continuous slurry delivery system as recited in claim 6 wherein said physical property is selected from the group consisting of:

pressure, temperature, humidity, density, viscosity, zeta potential, and light transmittance.

8. The continuous slurry delivery system as recited in claim 1 wherein said mixing chamber further comprises an agitator for mixing said slurry.

9. The Continuous slurry delivery system as recited in claim 1 wherein each of said slurry component tanks further comprise a meter device configured to meter a measured rate of said different slurry component into said mixing chamber.

10. The continuous slurry delivery system as recited in claim 1 further comprising a pressurized delivery system in fluid connection with said slurry delivery system and configured to deliver a pressurized fluid through a nozzle onto a polishing pad.

11. The method as recited in claim 10 wherein sensing an ion concentration includes sensing an ion concentration selected from the group consisting of:

hydronium ion concentration, hydroxyl ion concentration, metal ion concentration, and non-metal ion concentration.

12. A method of forming a continuous slurry for a semiconductor polishing system, comprising:

dispensing a slurry component at a required rate into a mixing chamber from at least one of slurry component tanks in fluid connection with said mixing chamber, each of said slurry component tanks containing a different slurry component;

sensing a chemical parameter of said slurry with a chemical parameter sensor system coupled to said mixing chamber;

dispensing at least one of another of said slurry components into said mixing chamber at a given rate by way of a control system coupled to said chemical parameter sensor system; and transferring said slurry from said mixing chamber into a pre-dispensing chamber.

13. The method as recited in claim 12 wherein sensing a chemical parameter includes sensing an ion concentration or conductivity in said slurry.

14. The method as recited in claim 12 wherein dispensing includes dispensing different slurry components selected from the group consisting of:

an oxidant, a surfactant, an abrasive, a buffer, a corrosion inhibitor, an acid, a base, and water.

15. The method as recited in claim 12 wherein sensing a chemical parameter includes sensing a chemical parameter of a slurry within said pre-mixing chamber or said pre-dispensing chamber.

16. The method as recited in claim 12 further comprising sensing a physical parameter of said slurry with a physical parameter sensor system coupled to said mixing chamber.

17. The method as recited in claim 16 wherein sensing a physical parameter includes sensing a physical property selected from the group consisting of:

pressure, temperature, humidity, density, viscosity, zeta potential, and light transmittance.

18. The method as recited in claim 12 further comprising mixing said slurry in said mixing chamber with an agitator.

19. The method as recited in claim 12 wherein dispensing includes metering a measured rate of said different slurry component with a meter.

20. The method as recited in claim 12 further comprising ejecting a pressurized fluid onto a polishing pad with a pressurized fluid dispensed from a pressurized delivery system in fluid connection with a slurry delivery system and configured to deliver a pressurized fluid through a nozzle onto a polishing pad.

21. A method of fabricating a semiconductor wafer, comprising:

forming a material layer on a semiconductor substrate;

retaining said semiconductor substrate in a polishing head of a polishing apparatus; and delivering a continuous slurry to a platen of said polishing apparatus by:

dispensing a slurry component at a required rate into a mixing chamber from at least one of slurry component tanks in fluid connection with said mixing chamber, each of said slurry component tanks containing a different slurry component;

sensing a chemical parameter of said slurry with a chemical parameter sensor system coupled to said mixing chamber;

dispensing at least one of another of said slurry components into said mixing chamber at a given rate by way of a control system coupled to said chemical parameter sensor system;

transferring said slurry from said mixing chamber into a pre-dispensing chamber;

transferring said slurry from said pre-dispensing chamber on a polishing platen; and polishing said material layer against said polishing platen.

22. The method as recited in claim 21 wherein polishing includes polishing a substrate, a dielectric layer or a metal layer.

23. The method as recited in claim 21 further comprising forming interconnected integrated circuits on said semiconductor wafer.

* * * * *